US008467550B2

(12) United States Patent
Akino

(10) Patent No.: US 8,467,550 B2
(45) Date of Patent: Jun. 18, 2013

(54) CONDENSER MICROPHONE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 0 days.

(21) Appl. No.: 13/397,207

(22) Filed: Feb. 15, 2012

(65) Prior Publication Data

US 2012/0213390 A1 Aug. 23, 2012

(30) Foreign Application Priority Data

Feb. 17, 2011 (JP) ..... 2011-031842

(51) Int. Cl.
*H04R 25/00* (2006.01)

(52) U.S. Cl.
USPC ..... 381/174; 381/111; 381/113

(58) Field of Classification Search
USPC ..... 381/91, 92, 111, 113, 122, 355, 359, 381/361, 362, 174, 175, 384; 439/95, 101
See application file for complete search history.

(56) References Cited

U.S. PATENT DOCUMENTS 7,046,815 B2 * 5/2006 Akino et al. ..... 381/122
7,848,532 B2 * 12/2010 Akino ..... 381/113
7,970,154 B2 * 6/2011 Akino ..... 381/113

* cited by examiner

*Primary Examiner* — Huyen D Le
(74) *Attorney, Agent, or Firm* — Manabu Kanesaka

(57) ABSTRACT

To provide a condenser microphone having a removable head unit on the microphone body, wherein the head unit can be attached and detached to and from the microphone body through one connection at a low impedance. A second pin **22*h* and a third pin 22*c* of a microphone body 20, which has a 3-pole output connector, is connected with current regulative diodes D2 and D3 as a feed circuit for the drain D of the FET Q1. A first AC coupling electrolytic capacitor C3 is connected to one of the current regulative diodes, D2, and a series circuit of a second AC coupling electrolytic capacitor C4 and a resistive element R3 is connected between the anode of the other current regulative diode D3 and a ground line L3. The resistive element R3 has substantially the same impedance as an output impedance of the transistor Q2**.

4 Claims, 1 Drawing Sheet

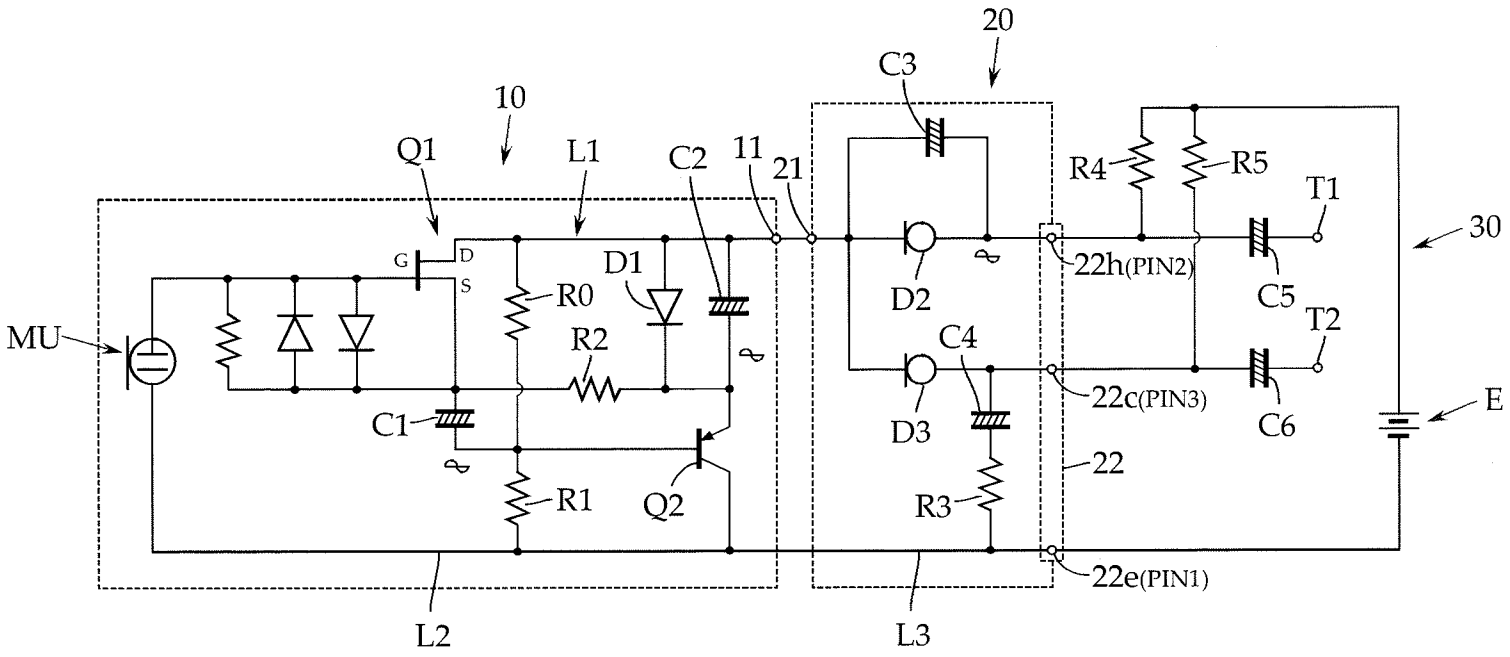
30
E
T1
T2
C5
C6
R5
R4
22h(PIN2)
22c(PIN3)
22
22e(PIN1)
20
C3
D2
C4
D3
R3
L3
21
11
C2
D1
Q2
L1
R0
R2
R1
10
Q1
D
S
G
C1
L2
MU

CONDENSER MICROPHONE

CROSS-REFERENCE TO RELATED APPLICATION

The present application is based on, and claims priority from, Japanese Application Serial Number JP2011-031842, filed Feb. 17, 2011, the disclosure of which is hereby incorporated by reference herein in its entirety.

TECHNICAL FIELD

The present invention relates to a condenser microphone, and in particular to a condenser microphone operated with a phantom power supply, the condenser microphone having an interchangeable head unit on the microphone body.

BACKGROUND ART

Some condenser microphones have an interchangeable head unit (or head section), which includes a condenser microphone unit as an electrostatic electroacoustic transducer, on the microphone body (or grip section for a hand-held microphone) for the purpose of changing the directivity.

In such type of microphone, however, an electrical connection is present between the head unit and the microphone body, presenting an extremely high impedance at a signal output part of the condenser microphone unit. Consequently, noises are likely to be generated when external electromagnetic waves radiated from, for example, a mobile phone are arriving from the outside.

Thus, the applicant has proposed in Japanese Patent Application Publication No. 2006-313952 to connect an inductor used as a choke coil in series between a ground on the head unit side and another ground on the microphone body side.

As a matter of fact, however, noises have not yet been suppressed low enough to reach a satisfactory level according to Japanese Patent Application Publication No. 2006-313952 due to low signal levels and the extremely high impedance of the condenser microphone.

Generally, a field-effect transistor (FET) is used for an impedance converter for a condenser microphone. There are two ways to extract signals from a condenser microphone having an FET on the head unit side: to extract sound signals from the drain side of the FET and to extract sound signals from the source side of the FET.

In the case of extracting sound signals from the drain side of the FET, the drain line serves as both a feed line and a signal output line. Thus, since only one connection can be provided between the head unit and the microphone body, the structure can be simplified. Unfortunately, sound signals are easily distorted due to a low level of the signals.

On the other hand, in the case of extracting sound signals from the source side of the FET, sound signals are not distorted to a large extent. In this case, however, two connections are required because the power must be separated from the signals, resulting in a complex structure.

In the meantime, to design a condenser microphone operated with a phantom power supply, it is necessary to take into consideration a feed voltage from the phantom power supply.

According to EIAJ RC-8162A "Power Supply Method for Microphone," 3 allowable rated voltages are defined for phantom power supplies for condenser microphone: 12±1V, 24±4V, and 48±4V.

In order to operate a microphone with a higher maximum output level within the respective voltage range of phantom power supplies, which have such different rated voltages, the applicant has proposed Japanese Patent Application Publication No. 2006-352622 and Japanese Patent Application Publication No. 2007-006178.

An object of the present invention is to provide a condenser microphone operated with a phantom power supply, the condenser microphone having an interchangeable head unit on the microphone body, wherein the head unit can be attached and detached to and from the microphone body through one connection at a low impedance.

SUMMARY OF THE INVENTION

In order to attain the above object, the present invention is characterized by a condenser microphone comprising: a condenser microphone unit; a head unit including an FET for converting capacitance changes in the condenser microphone unit into sound signals and an emitter-follower current gain transistor for amplifying the sound signals appearing at source of the FET in a predetermined manner; and a microphone body including a 3-pole output connector to which a phantom power supply is connected and a feed circuit having first and second current regulative diodes fed from the phantom power supply for applying a drive current to drain of the FET, the head unit being connected to the microphone body in an electrically and mechanically removable manner, wherein on the head unit side, the current gain transistor is connected between the drain of the FET and a ground, a drain line connected to the drain of the FET serves as both a feed line and a signal output line, and the drain line has a first connecting terminal to the microphone body, wherein on the microphone body side, the first and second current regulative diodes are connected to a second pin on hot side and a third pin on cold side of the 3-pole output connector, respectively, respective cathode sides of the first and second current regulative diodes are both connected to a second connecting terminal that is a counterpart of the first connecting terminal, a first AC coupling capacitor element is connected between cathode and anode of the first current regulative diode, and a series circuit of a second AC coupling capacitor element and a resistive element is connected between anode of the second current regulative diode and a ground, and wherein when the head unit and the microphone body are connected, connections are made between the first and second connecting terminals and between the grounds.

According to a preferable aspect of the invention, an impedance of the resistive element substantially matches with an output impedance of the current gain transistor.

In order to secure a maximum output level depending on each phantom power supply even when phantom power supplies with different rated voltages are used, voltage divider resistors for dividing a voltage of the phantom power supply supplied from the second connecting terminal to create a bias voltage applied to base of the current gain transistor are connected between the drain line and the ground.

Equal voltages are applied to the second and third pins from the phantom power supply.

According to the invention, only one connection is required for a signal system because the FET serving as an impedance converter is mounted on the head unit side and sound signals are extracted from the drain side of the FET. Additionally, the output impedance at the output of the current gain transistor is as low as, for example, about 200Ω irrespective of feed voltages from the phantom power supply. This enables the head unit to be attached and detached to and from the microphone body through one connection at a low impedance.

BRIEF DESCRIPTION OF THE DRAWINGS

FIG. 1 is a circuit diagram showing a condenser microphone according to an embodiment of the invention.

DETAILED DESCRIPTION

An embodiment of the invention will now be described, although the present invention is not limited to the embodiment.

As shown in FIG. 1, a condenser microphone according to the embodiment includes a head unit (or head section) 10 and a microphone body (or grip section for a hand-held microphone) 20, and the head unit 10 can be attached and detached to and from the microphone body 20.

Although not shown, the head unit 10 and the microphone body 20 each have a cylindrical housing made of metal such as aluminum or a brass alloy. The housings are threadably connected with each other. The housings are used as a ground.

The head unit 10 contains a condenser microphone unit (hereinafter, also referred to as a microphone unit) MU, a field-effect transistor (FET) Q1 serving as an impedance converter, and a current gain circuit composed of an emitter-follower current gain transistor Q2.

The microphone unit MU is preferably an electret type, although any other types may be used. The microphone unit MU is connected to gate G of the FET Q1 on the fixed pole side and to a ground line (housing) L2 on the diaphragm side.

In this embodiment, the FET Q1 has a built-in bias circuit, that is, the FET Q1 includes a bias circuit composed of a combination of two diodes and one resistive element.

The condenser microphone is adapted to extract sound signals from drain D of the FET Q1. A drain line L1 connected to the drain D serves as both a feed line and a signal output line, and the drain line L1 has on one end thereof a first connecting terminal 11 to the microphone body 20.

In this embodiment, the transistor Q2 is of PNP type, emitter of which is connected to the drain line L1 through an AC coupling electrolytic capacitor C2. Collector is connected to the ground line L2. Source S of the FET Q1 is connected to base of the transistor Q2 through an AC coupling electrolytic capacitor C1.

The source S of the FET Q1 is connected to emitter of the transistor Q2 through a resistive element R2 for output. A diode D1 is connected between the drain D and the source S of the FET Q1 for keeping a voltage between the drain and the source constant.

Voltage divider resistive elements R0 and R1 for dividing a voltage of the phantom power supply supplied from the connecting terminal 11 to apply a bias voltage applied to the base of the transistor Q2 are connected between the drain line L1 and the ground line L2.

In this way, even when phantom power supplies with different rated voltages (12V, 24V, and 48V) are used, the bias voltage to the transistor Q2 changes accordingly so as to secure a maximum output level depending on each of the phantom power supplies. Even with a phantom power supply with any voltage, therefore, the output impedance at the output of the transistor Q2 can be as low as about 200 Ω.

Meanwhile, the microphone body 20 is provided with a 3-pole output connector 22 to which a phantom power supply 30 is connected, and two current regulative diodes D2 and D3 as a feed circuit for the head unit 10.

The 3-pole output connector 22 is a connector of the type defined in EIAJ RC-5236 "Latch Lock Type Round Connector for Acoustic Equipment" or equivalent, and has a first pin 22*e* for ground, a second pin 22*h* for a signal on the hot side, and a third pin 22*c* for a signal on the cold side.

The current regulative diode D2 is connected to the second pin 22*h* on the anode side, and the current regulative diode D3 is connected to the third pin 22*c* on the anode side. Cathode of the current regulative diode D2 and that of the diode D3 are both connected to a second terminal 21 that is a counterpart of the first connecting terminal 11 on the head unit 10.

An AC coupling electrolytic capacitor C3 is connected between the cathode and the anode of the current regulative diode D2. A series circuit of an AC coupling electrolytic capacitor C4 and a resistive element R3 is connected between the anode of the current regulative diode D3 and a ground line L3. The ground line L3 may be the housing of the microphone body 20 and is connected to the first pin 22*e*.

The phantom power supply 30 has a DC power source E set to any of 12V, 24V, and 48V, and is connected to the first pin 22*e* on the negative pole side. The DC power source E is connected on the positive pole side to the second pin 22*h* and the third pin 22*c* through resistive elements R4 and R5, both of which have the same value of resistance. As an example, in the case where the DC power source E is 48V, both the resistive elements R4 and R5 may be 6.8 kΩ.

According to the configuration described above, when the head unit 10 and the microphone body 20 are connected, connections are made between the first and second connecting terminals 11 and 21 and between the ground lines L2 and L3. Since the connection between the ground lines L2 and L3 is made by the housings, the connection for the signal system is made at only one point of the connecting terminals 11 and 12. For the first and second connecting terminals 11 and 12, a predetermined connector member made up of a combination of, for example, a terminal pin and a blade spring may be used.

In operation of the microphone connected with the phantom power supply 30, current is supplied from the current regulative diodes D2 and D3 to the drain D of the FET Q1 through the connecting terminals 11 and 21 and the drain line L1. Capacitance changes in the microphone unit MU caused by incoming sound waves are output as sound signals from the source of the FET Q1.

The sound signals are amplified by the emitter-follower transistor Q2 in a predetermined manner, and are output from the emitter side of the transistor Q2 to the microphone body 20 side through the drain line L1 and connecting terminals 11 and 21.

On the microphone body 20 side, the sound signals reach the second pin 22*h* through the AC coupling electrolytic capacitor C3. The sound signals are then output from output terminals T1 and T2 having AC coupling electrolytic capacitors C5 and C6 connected to the second pin 22*h* and the third pin 22*c* to a sound output circuit such as a mixer.

As described above, in the embodiment, the output impedance at the output of the transistor Q2 is as low as about 200Ω, while the current regulative diodes D2 and D3 have a higher impedance in terms of AC, the head unit 10 can be attached and detached to and from the microphone body 20 through one connection for the signal system at a low impedance. Further, no output transformer is required.

For the impedance matching of the second pin 22*h* side and the third pin 22*c* side, the value of resistance of the resistive element R3 connected on the third pin 22*c* side is preferably matched with the output impedance at the output of the transistor Q2 (in this embodiment, about 200Ω).

The invention is claimed:

1. A condenser microphone, comprising:

a condenser microphone unit;

a head unit including an FET for converting capacitance changes in the condenser microphone unit into sound signals and an emitter-follower current gain transistor for amplifying the sound signals appearing at source of the FET in a predetermined manner; and a microphone body including a 3-pole output connector to which a phantom power supply is connected and a feed circuit having first and second current regulative diodes fed from the phantom power supply for applying a drive current to drain of the FET, the head unit being connected to the microphone body in an electrically and mechanically removable manner, wherein on the head unit side, the current gain transistor is connected between the drain of the FET and a ground, a drain line connected to the drain of the FET serves as both a feed line and a signal output line, and the drain line has a first connecting terminal to the microphone body, wherein on the microphone body side, the first and second current regulative diodes are connected to a second pin on hot side and a third pin on cold side of the 3-pole output connector, respectively, respective cathode sides of the first and second current regulative diodes are both connected to a second connecting terminal that is a counterpart of the first connecting terminal, a first AC coupling capacitor element is connected between cathode and anode of the first current regulative diode, and a series circuit of a second AC coupling capacitor element and a resistive element is connected between anode of the second current regulative diode and a ground, and wherein when the head unit and the microphone body are connected, connections are made between the first and second connecting terminals and between the grounds.

2. The condenser microphone according to claim 1, wherein an impedance of the resistive element substantially matches with an output impedance of the current gain transistor.

3. The condenser microphone according to claim 1, wherein voltage divider resistors for dividing a voltage of the phantom power supply supplied from the second connecting terminal to create a bias voltage applied to base of the current gain transistor are connected between the drain line and the ground.

4. The condenser microphone according to claim 1, wherein equal voltages are applied to the second and third pins from the phantom power supply.

* * * * *